United States Patent [19]

Van Eyk

[11] Patent Number: 4,834,009

[45] Date of Patent: May 30, 1989

[54] SLEEVE BACKTACK

[75] Inventor: John Van Eyk, Oak Flats, Australia

[73] Assignee: Union Special Corporation, Chicago, Ill.

[21] Appl. No.: 269

[22] Filed: Jan. 2, 1987

[30] Foreign Application Priority Data

Jun. 2, 1986 [AU] Australia ..... 58359/86

[51] Int. Cl.[4] ..... D05B 65/02

[52] U.S. Cl. ..... 112/288; 112/130; 112/253

[58] Field of Search ..... 112/288, 286, 287, 253, 112/DIG. 3, 130

[56] References Cited

U.S. PATENT DOCUMENTS

| | | | |
|---|---|---|---|
| 3,698,336 | 10/1972 | Launer | 112/288 X |
| 4,220,105 | 9/1980 | Palacino | 112/288 X |
| 4,303,030 | 12/1981 | Palacino et al. | 112/286 |
| 4,453,481 | 6/1984 | Garnett et al. | 112/288 |
| 4,644,884 | 2/1987 | Tatsumi | 112/288 X |
| 4,679,515 | 7/1987 | Keeton | 112/288 X |

FOREIGN PATENT DOCUMENTS

| | | | |
|---|---|---|---|
| 61-45797 | 5/1986 | Japan | 112/288 |

*Primary Examiner*—H. Hampton Hunter
*Attorney, Agent, or Firm*—Emrich & Dithmar

[57] ABSTRACT

An apparatus for cutting and positioning a chain of stitches for stitching onto material in a sewing machine having a needle and a throat plate, comprising, a cutting knife adapted to sever the chain of stitches after the chain has been sewn onto the material, a device adapted to move the severed chain to a position forwardly of the needle, and a gripping device adapted to be positioned at a level below the throat plate during sewing of the chain stitches onto the material, and to rise up and grip the thus positioned severed chain, and return to below the level of the throat plate to hold the chain, to effect incorporation of the chain during the initial stitches into the seam being formed.

15 Claims, 5 Drawing Sheets

SLEEVE BACKTACK

CROSS REFERENCE TO RELATED APPLICATIONS

The present application is related to application Ser. Nos.: 068,587, filed June 30, 1987 and 050,360, filed May 18, 1987.

BACKGROUND OF THE INVENTION

The present invention relates to an apparatus for use with a sewing machine to cut a chain of stitches, trailing from a sewn garment and hold the cut chain in a predetermined location so as to be positioned to be incorporated into the leading portion of the seam of the next garment to be sewn.

Sewing machines that form seams utilizing chain stitches on a succession of pieces of material with the seam being continued into the area intermediate the pieces of material, are well-known. With seams of this type, means are provided for detaching the pieces of material one from the other by appropriate automatic chain-cutting devices after the sewn pieces have been caused to travel beyond the needle and the presser foot of the machine.

By cutting the chain of stitches with these devices, one portion of minimal length remains attached to the stitched piece of material and the other being connected to the throat plate is manipulated to a position forwardly of the needle so that it can be incorporated into the initial portion of the seam that will be formed on the next piece of material or workpiece. This procedure prevents a slackening of the seam's initial stitches which would give the leading edge of the workpiece an undesirable appearance.

The known devices for performing this function include a chain-cutting device disposed adjacent the stitch finger of the throat plate which co-operates with a chain-orienting device and gripper apparatus located forwardly the needle and usually adjacent the forward portion of the throat plate.

These apparatii suffer from the disadvantages that, because the portion of the chain to be sewn onto the next garment is located on the upper surface of the throat plate intermediate the needle hole, the gripping apparatus is frequently accidentally displaced while positioning the next workpiece in the sewing area.

The material to be sewn interferes with the chain, preventing the proper insertion of the latter into the new seam being sewn, due to the pressure and friction of the piece of material of the chain which tend to dislodge it from the gripping apparatus and move it toward the trimmer knife of the machine that is adjacently disposed, thereby hindering subsequent handling of the chain.

The following patents generally relate to this subject matter: U.S. Pat. No. 3,490,403, U.S. Pat. No. 4,453,481, U.S. Pat. No. 4,599,960, U.S. Pat. No. 4,599,961, U.S. Pat. No. 4,303,030, U.S. Pat. No. 4,187,793, U.S. Pat. No. 4,038,933, U.S. Pat. No. 4,149,478, U.S. Pat. No. 4,220,105, U.S. Pat. No. 3,541,984, U.S. Pat. No. 3,698,336, and British application 2,058,858.

SUMMARY OF THE INVENTION

A principal feature of the present invention is the provision of an improved sewing machine.

The sewing machine has an apparatus for cutting and positioning a chain of stitches for stitching onto material in the machine having a needle and a throat plate, comprising, a cutting knife adapted to sever the chain of stitches after the chain has been sewn onto the material, positioning means adapted to move the severed chain to a position forwardly of the needle, and gripping means adapted to grasp the severed chain.

A feature of the present invention is that the gripping means is normally positioned below the throat plate of the sewing machine.

Another feature of the invention is that the gripping means rises above the throat plate to receive and grasp the severed chain.

Yet another feature of the invention is that the severed chain is grasped below the level of the throat plate.

A further feature of the invention is that the chain is grasped in a taut configuration.

Still another feature of the invention is that the severed chain is grasped with varying forces.

Further features will become more fully apparent in the following description of the embodiments of this invention and from the appended claims.

DESCRIPTION OF THE PREFERRED EMBODIMENTS

Figure 1:
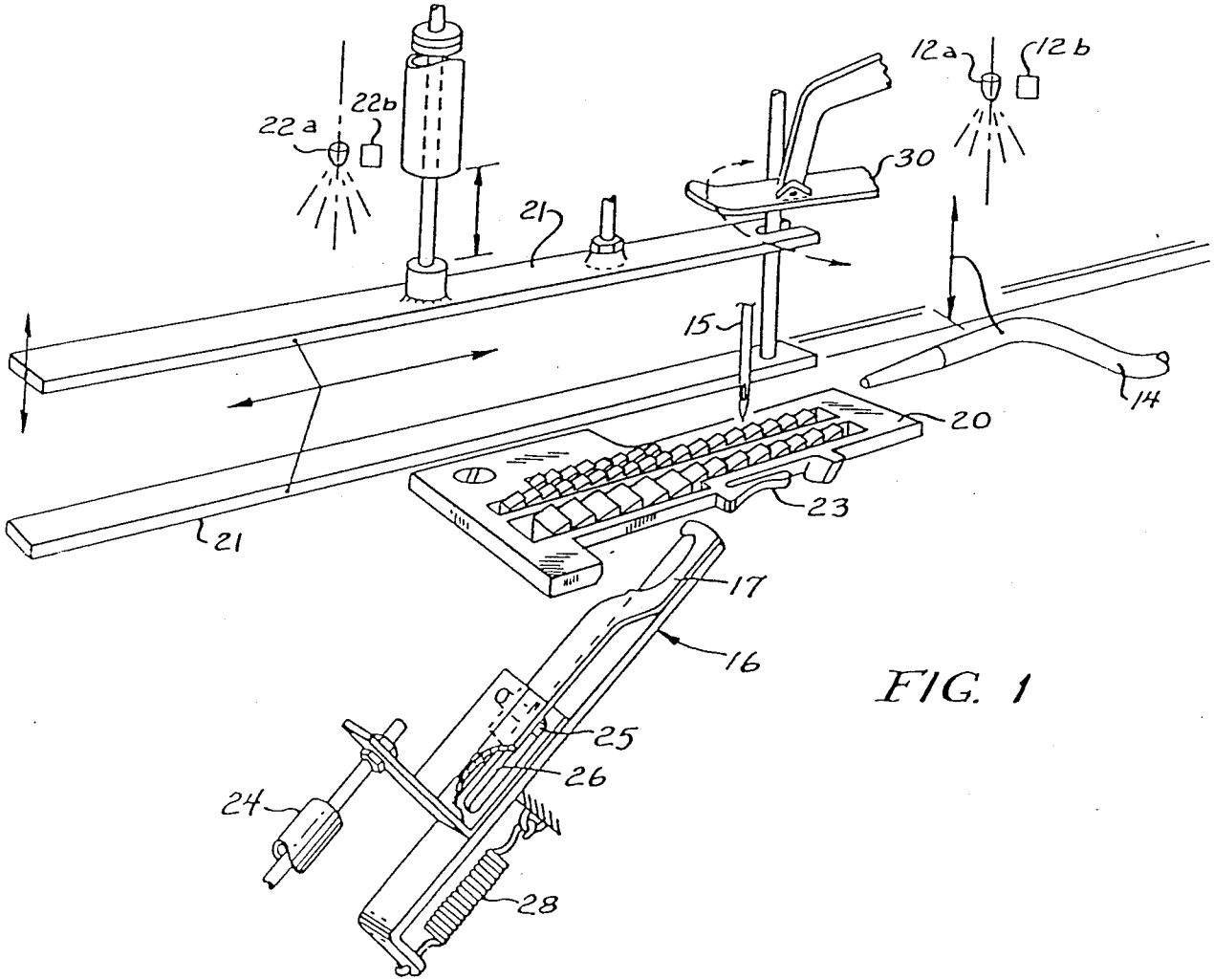
FIG. 1 is a schematic perspective view of an embodiment of a sewing machine of the present invention.

As the general construction and operation of a sewing machine, which may be of Federal Stitch Type 504, to which the present invention is applicable, is well-known and familiar to those conversant in the art, and as the invention is primarily concerned with a device for positioning and gripping a chain of stitches for incorporation into the initial stitches of a new seam, it is only considered necessary here to illustrate and describe those parts which are directly concerned with a preferred form of the invention.

With reference to FIGS. 1–5, the sewing machine has a throat plate 20 with a stitch finger or tongue 23 positioned adjacent a reciprocating needle 15, and a presser foot 30. The sewing machine has a movable clamp 21 adjacent the throat plate comprising a material feed mechanism 19, and a cutter 13 along with a blower 14 for positioning a chain 18 of stitches. The sewing machine has an associated first light emitter **12*a* and light detector 12*b*, and a second light emitter 22*a* and light detector 22*b***.

The sewing machine has a gripping apparatus 16 having a hook member 17 movable between a first position above the throat plate 20 and a second position beneath the throat plate 20. The gripping apparatus 16 has a pneumatic cylinder 24 connected to the hook member 17. The gripping apparatus 16 has an extension 25 which slides in a slot 26 of the member 27 of the gripping apparatus 16. In a lower position of the hook member 17, the extension 25 abuts against the member 27, and the member 27 and hook member 17 are withdrawn beneath the throat plate 20 against the biasing of a spring 28. The spring 28 biases the member 27 to an upper initial position when the hook member 17 starts its upward motion.

Figure 2:
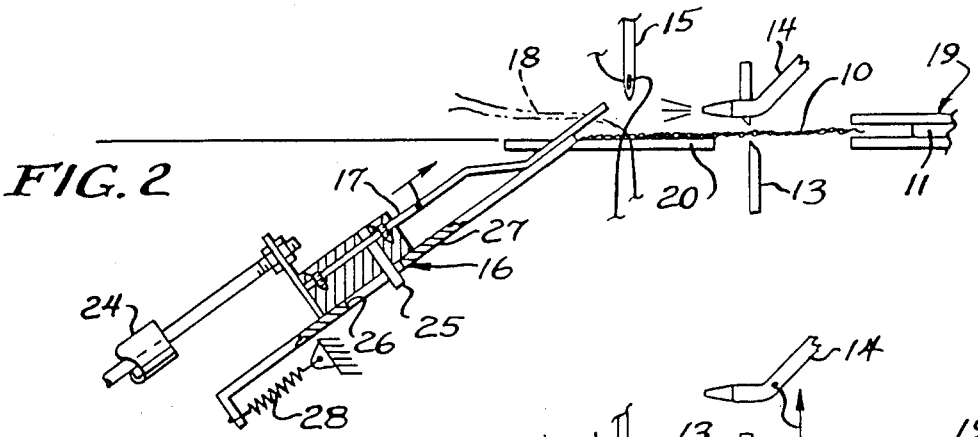
FIGS. 2–5 illustrate the cycle of operation of the machine of FIG. 1.

As shown in FIGS. 1 and 2, after the chain 10 is sewn onto the material 11, the clamp 21 moves away from the needle 15 and presser foot 30 and pulls the threads off the stitch finger or tongue 23. Light is emitted by light emitter 12*a*, and light detector 12*b* senses a change of reflectivity from a lower surface, such that the detector 12*b* senses the end of the material in response to which the cutter 13 severs the chain 10. The positioning means, in the form of a blower 14, directs a stream of air onto the severed chain to blow it back forwardly of the needle 15, as shown by the phantom chain 18. Alternatively, the machine may have a plurality of blowers to sequentially move the chain forwardly of the needle. The gripping means or apparatus 16 is activated, and the hook member 17 rises to hook around the severed chain 18.

Figure 3:
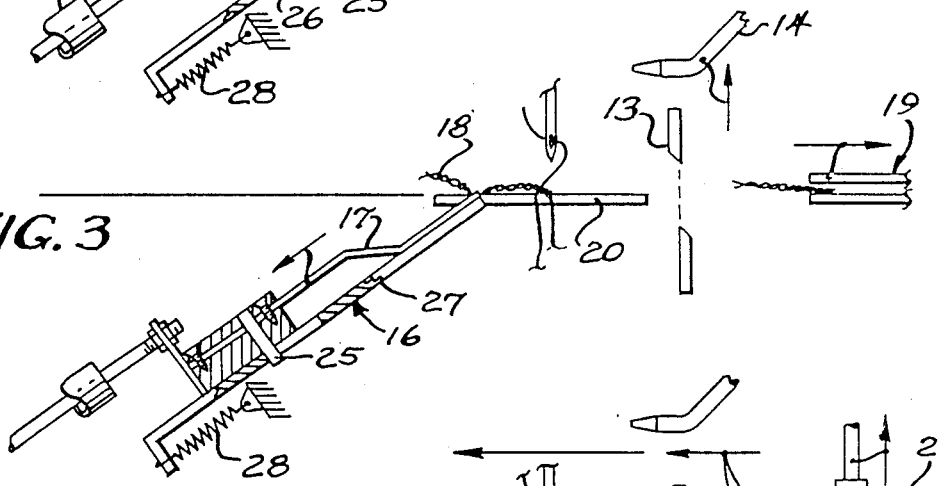

As shown in FIG. 3, the cutter 13 opens with the material feed mechanism 19 moving the sewn material to a conveyor (not shown).

The blower 14 shuts off and is raised. The hook member 17 returns to below the throat plate 20, clamping the severed chain in the gripping means 16.

Figure 4:
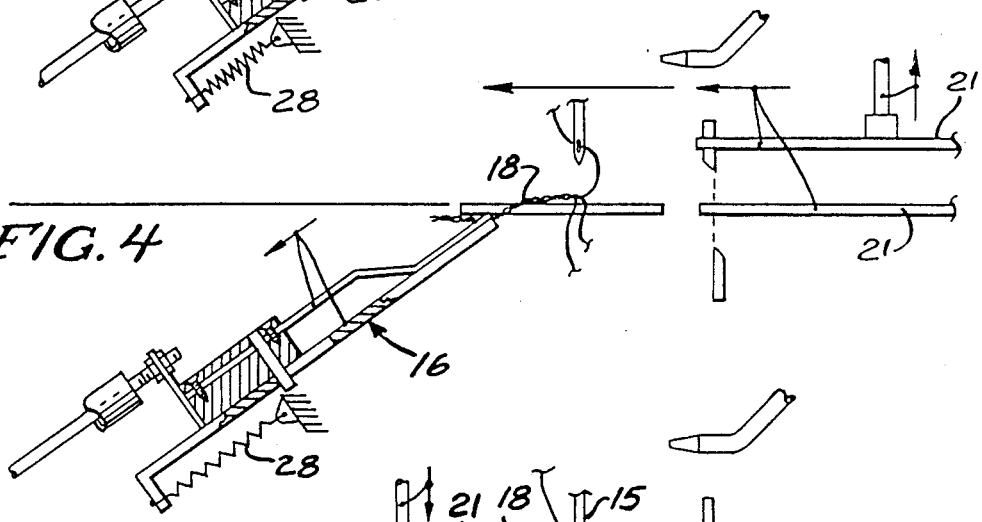
Figure 5:
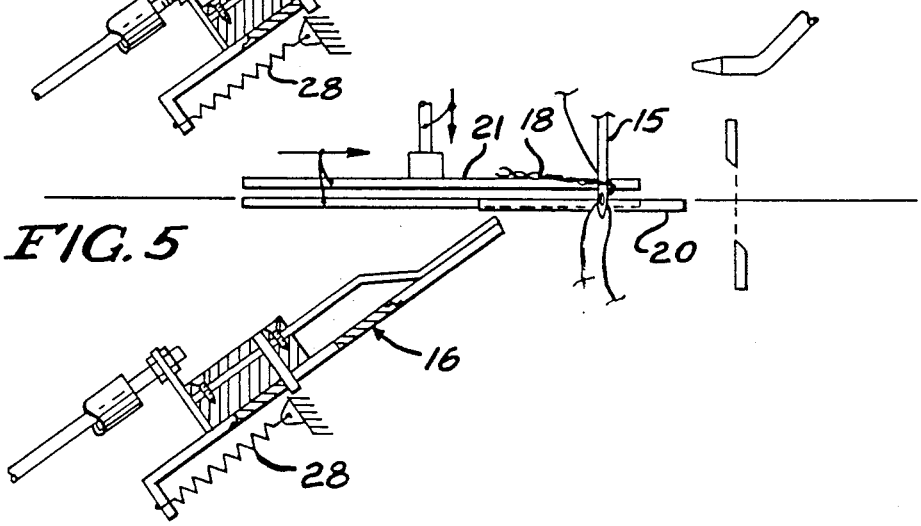

As shown in FIG. 4, the clamp 21 opens, and the released garment is removed by the conveyor, with the clamp 21 returning to its starting position forwardly of the needle 15. Meanwhile, the gripping means 16 moves further below the throat plate 20, tensioning the chain 18. Light is emitted by light emitter 22*a*, and light detector 22*b* senses a change of reflectivity from a lower surface. When material is sensed by the detector 22*b*, the clamp 21 closes and the material is fed to the sewing machine, while the chain 18 is held in tension by the gripping means 16 for the initial stitching of the seam, to prevent slackening of the seam's initial stitches which would give the leading edge of the material an undesirable appearance.

Figure 13:
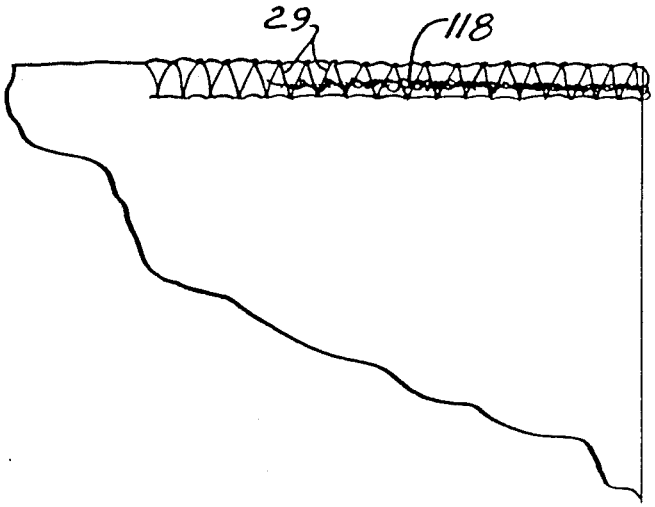
FIG. 13 is a fragmentary plan view of a fabric stitched with the sewing machine of the present invention.

As the material 11 is moved across under the needle 15 by the material feed mechanism 19, the end of the chain is pulled from the gripping means 16 and the chain 18 is sewn into the seam, and the cycle is repeated. The resulting sewn fabric is shown in FIG. 13 in which the chain 18 is shown beneath the seaming or overedge stitches 29.

The gripping means 16 is operated by a single pneumatic cylinder 24 which is directly connected to the hook member 17. When the piston of the cylinder 24 pushes the hook member 17 upwardly, as shown in FIG. 2, an extension 25 slides in a slot 26 of member 27 of the gripping means. Upon the hook member 17 being withdrawn, as shown in FIG. 3, the extension 25 slides in the slot 26 to then abut against the member 27, whereby both the member 27 and the hook member 17 are withdrawn further below the throat pate 20 against the biasing force of the spring 28, as shown in FIG. 4. Upon the hook member 17 starting its upward motion, the spring 28 returns the member 27 to its initial position below the throat plate 20.

Thus, the present invention, at all times, provides an apparatus for the cutting and the positioning of a chain stitch which ameliorates the problems of the prior art, by providing a mechanical gripping means 16 which holds the severed chain below the level of the throat plate, with the gripping means 16 being movable between positions below and above the throat plate 20.

In an alternative form, the light emitter 12*a* and light detector 12*b* may be omitted, and a time delay may be initiated or stitches may be counted after light detector 22*b* senses the material in order to activate the cutter 13.

Figure 6:
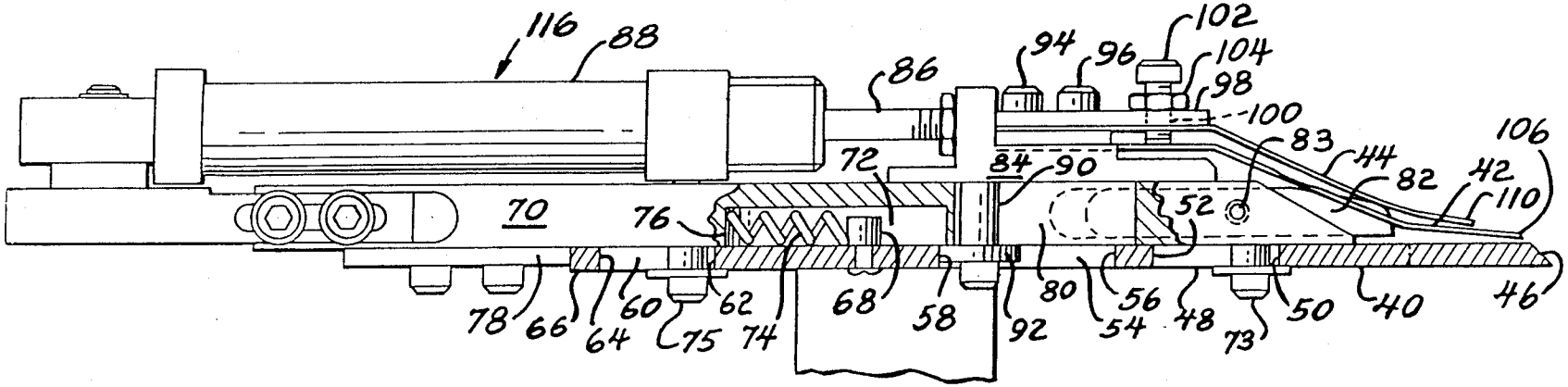
FIG. 6 is a side elevational view, partly broken away, of another embodiment of gripping apparatus for the sewing machine of FIG. 1.
Figure 7:
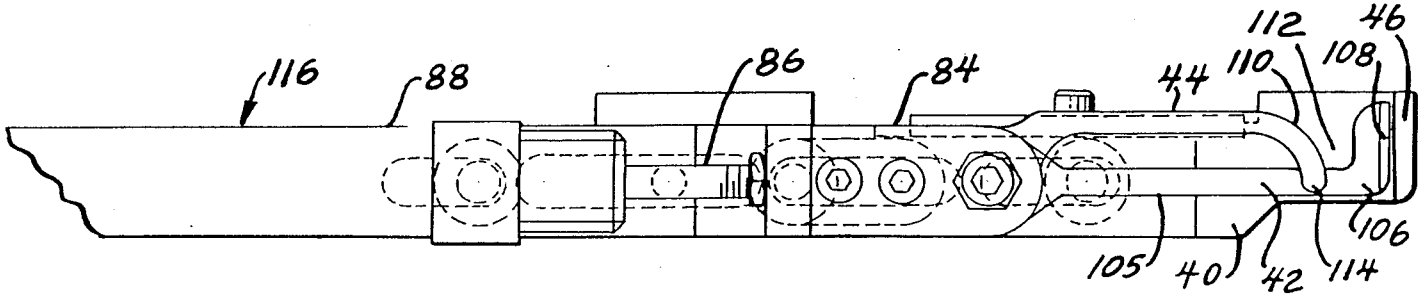
FIG. 7 is a fragmentary top plan view of the gripping apparatus of FIG. 6.
Figure 8:
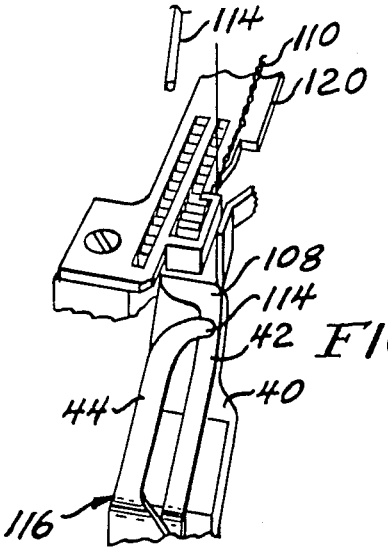
FIGS. 8–12 are fragmentary perspective views showing operation of the gripping apparatus of FIGS. 6 and 7.

Another embodiment of the gripping apparatus 16 is shown in FIGS. 6–12, with like parts being designated by the addition of 100 to the reference numeral in FIGS. 1–5. With reference to FIGS. 6–8, the gripping apparatus 116 has an elongated lower plate 40, an elongated nipper 42, and an elongated guide 44.

The plate 40 has a forward beveled edge 46, a first elongated slot 48 with opposed first and second ends 50 and 52, a second elongated slot 54 with first and second ends 56 and 58, and an elongated third slot 60 with first and second ends 62 and 64. The plate 40 also has a rearward end 66. The plate 40 has an upwardly directed pin 68 for a purpose which will be described below.

The gripping apparatus 16 has a stationary member 70 having cavity 72 facing the plate 40. A helical spring 74 is received in the cavity 72 and extends between one end 76 of the cavity 72 and the pin 68 of plate 40. In this configuration, the spring 74 is compressed and thus biases the plate 40 forwardly through the pin 68. The stationary member 70 has a rear stop 78 which bears against rearward end 66 of the plate 40 in this configuration of the gripping apparatus 16. The stationary member 70 has an elongated slot 80 extending therethrough and communicating with the second slot 54 of the plate 40. The stationary member 70 also has a forwardly directed cam 82 for a purpose which will be described below. The cam 82 is slidable in the stationary member 70, and may be secured at a desired position by a screw 83.

The gripping apparatus 116 has a movable retaining member 84 connected to and driven by the piston 86 of a cylinder 88. The retaining member 84 has a depending pin 90 extending through slot 80 of stationary member 70 and having a washer 92 received in the second slot 54 of plate 40. The retaining member 84 has a pair of screws 94 and 96 which fixedly secure rearward ends of the resilient nipper 42 and resilient guide 44 to the retaining member 84. The retaining member 84 has a forwardly directed flange 98 having a threaded aperture 100 to receive a screw 102 containing a nut 104 above the flange 98. The outer end of screw 102 bears upon the nipper 42 to bias the nipper 42 toward the plate 40. The screw 102 and nut 104 are adjustable in flange 98, such that the screw 102 may exert an adjustable bias against nipper 42 to accommodate different diameter sizes of threads.

The nipper 42 has an elongated bar 105 connected to a forward end 106 having an outwardly directed finger 108, with the forward end 106 being located near or against the plate 40.

The guide 44 has a forward curved end portion 110 spaced from the finger 108 of the nipper 42 to define a space 112 between the nipper finger 108 and end portion 110 of the guide 44. An outer end 114 of the guide 44 is located above the bar 105 of the nipper 42. In the configuration shown, the guide 44 bears against the cam 82 which raises the end 114 of the guide 44 from the nipper 42 for a purpose which will be described below. When the nipper 42 and guide 44 are moved forwardly by the retaining member 84, as will be described below, the guide 44 becomes disengaged from the cam 82 causing the end 114 of resilient guide 44 to engage against the bar 105 of nipper 42 causing further bias of the nipper 42 against the plate 40.

Figure 9:
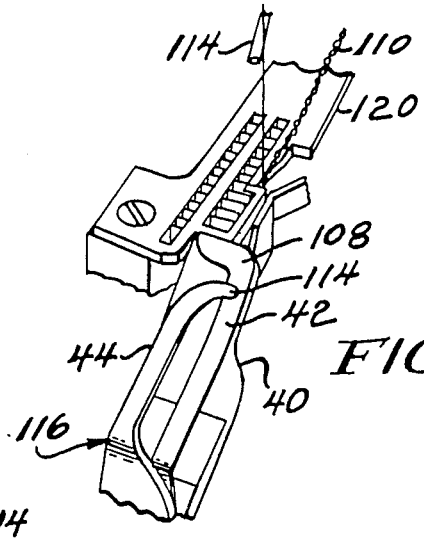

In operation, prior to severing the chain 110, the plate 40, nipper 42, and guide 44 are all located beneath the throat plate 20, as shown in FIG. 8, with the forward end of the nipper 42 located adjacent the forward end of the plate 40. With reference to FIGS. 6, 7, and 9, shortly before or after the chain 110 is severed, the cylinder 88 is activated causing forward movement of the retaining member 84 and retained nipper 42 and guide 44. At the same time, the pin 90 moves forwardly in the slot 80 of the stationary member 70, and the moving washer 92 permits forward movement of the spring biased plate 40 to a location with the beveled edge 46 located adjacent the throat plate 20. At this time, the screw 73 of stationary member 70 strikes the second end 52 of first slot 48 and the screw 75 of stationary member 70 strikes the second end 64 of third slot 60, thus preventing further forward movement of the plate 40 past the throat plate 20. However, with reference to FIGS. 6, 7, and 10, the cylinder 88 continues to drive the retaining member 84, thus moving the retained nipper 42 and guide 44 above the throat plate 20, while the pin 90 leaves the second end 58 of the second slot 54, since the plate 40 is no longer free to move forwardly past the throat plate 20.

Figure 10:
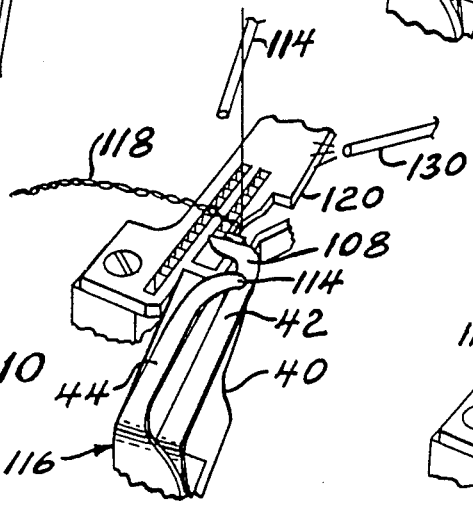
Figure 11:
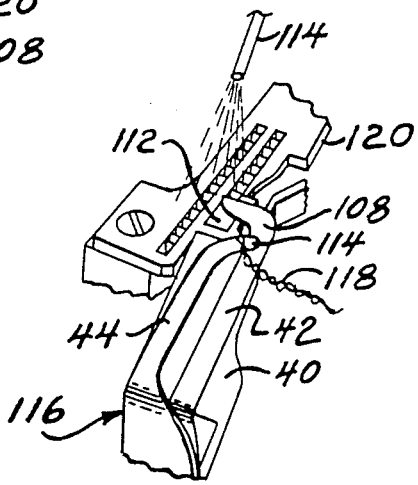

In this configuration of the gripping apparatus 16, the severed chain 118 is first moved to one side of the needle by a first blower 130, as shown in FIG. 10, and is then moved by the blower 114 into the space 112 between the nipper 42 and guide 44, with the curved guide 44 directing the chain 118 into the space 112, as shown in FIG. 11.

At this time, the cylinder 88 begins to retract the nipper 42 and guide 44 until the forward end of the nipper 42 is located adjacent the forward end of the plate 40 at the level of the throat plate 20. The severed chain 118 thus becomes caught between the finger 108 of the nipper 42 and the forward portion of the plate 40. Also, at this time, the washer 92 again engages against the second end 58 of second slot 54, and further retraction of the retaining member 84 also causes retraction of the plate 40 along with the nipper 42 and guide 44.

As previously discussed, when the guide 44 leaves the cam 82, the outer end 114 of the guide 44 is biased against the nipper 42 to apply an increased bias to the nipper 42 against the plate 40 in order to draw the chain 118 taut as the nipper 42 and guide 44 move beneath the throat plate 20.

Figure 12:
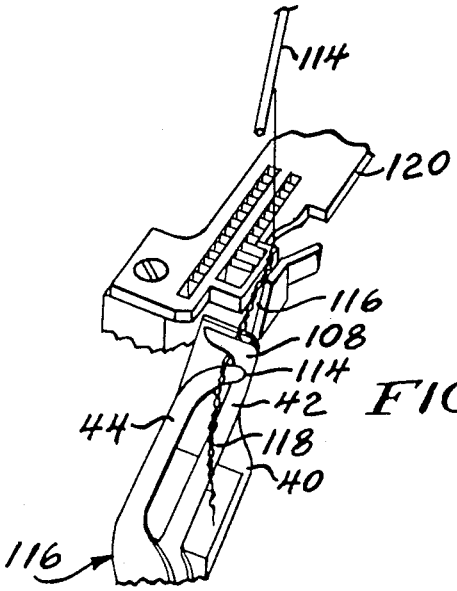

The cylinder continues to retract the nipper 42 and guide 44 beneath the throat plate 20, while driving the plate 40 through pin 90 to the configuration shown in FIG. 12 with the gripping apparatus 116 beneath the throat plate 120, with the chain 118 located in a groove 116 between the throat plate 120 and a conventional fabric cutter 118, and with the plate 40 striking the stop 78. At this time, the guide 44 engages the cam 82, and the end 114 of guide 44 becomes disengaged from the nipper 42 to provide a lessened bias between the nipper 42 and plate 40. Although the chain 118 is drawn taut beneath the top of throat plate 20, the lessened bias of the nipper 42 permits easy removal of the chain 118 from the nipper 42 and plate 40 to prevent distortion of the first few stitches of the next sewn fabric. As previously discussed, the chain 118 is released from the gripping apparatus as the next fabric is sewn over the chain resulting in the sewn fabric of FIG. 13.

The foregoing detailed description is given for clearness of understanding only, and no unnecessary limitations should be understood therefrom, as modifications will be obvious to those skilled in the art.

What is claimed is:

1. An apparatus for cutting and positioning a chain of stitches for stitching onto material in a sewing machine having a needle and a throat plate, comprising:
- means for cutting the chain of stitches;
- means for positioning the severed chain forwardly of the needle;
- means for grasping the chain with a first larger tension at a location adjacent the throat plate and a second lesser tension at a location beneath the throat plate.

2. An apparatus for cutting and positioning a chain of stitches for stitching onto material in a sewing machine having a needle and a throat plate, comprising:
- means for cutting the chain of stitches;
- means for positioning the severed chain forwardly of the needle;
- a nipper having an outwardly directed finger;
- means for moving the nipper between a first position with the finger located beneath the throat plate and a second position with the finger located above the throat plate;
- a plate having a forwardly directed end; and
- means for moving the plate between a first position with the end located beneath the throat plate, and a second position with the end located adjacent the throat plate, said finger catching the severed chain and drawing it to a position between the finger and plate to releasably grasp the chain.

3. The apparatus of claim 2 including means for applying a force between the nipper and plate.

4. The apparatus of claim 3 wherein the nipper is resilient, and the applying means comprises means for pressing the nipper toward the plate.

5. The apparatus of claim 2 including means for applying a first larger force between the nipper and plate when the chain is first grasped between the finger and plate, and for applying a second lesser force between the nipper and plate when the chain is drawn beneath the throat plate.

6. An apparatus for cutting and positioning a chain of stitches for stitching onto material in a sewing machine having a needle and a throat plate, comprising:
- means for cutting the chain of stitches;
- means for positioning the severed chain forwardly of the needle;
- a nipper having an outwardly directed finger;
- means for moving the nipper between a first location beneath the throat plate and a second position above the throat plate;
- a guide forming a space between the guide and the finger to catch the severed chain;
- means for moving the guide together with the nipper between a first location beneath the throat plate and a second position above the throat plate;
- a plate adjacent the nipper to releasably grasp the severed chain between the finger and plate; and
- means for moving the plate between a first location beneath the throat plate and a second position adjacent the throat plate.

7. The apparatus of claim 6 including means for biasing the nipper toward the plate.

8. The apparatus of claim 7 including means for biasing the guide against the nipper toward the plate when the finger is located adjacent the throat plate and for releasing the guide bias when the nipper finger is located beneath the throat plate.

9. The apparatus of claim 12 wherein the nipper has an elongated bar connected to the finger, and in which the guide has a curved end portion with an end located above the bar.

10. The apparatus of claim 9 wherein the guide is resilient and normally bears against the nipper bar, and in which the guide biasing and releasing means comprises a cam disposed to lift the guide from the bar when the guide and nipper are located at the first locations beneath the throat plate and release the guide for engagement against the bar when the nipper and guide are located above said first locations.

11. The apparatus of claim 7 including means for adjusting the bias of the nipper toward the plate.

12. The apparatus of claim 11 wherein the adjusting means comprises a screw bearing with an adjustable force on the nipper.

13. An apparatus for cutting and positioning a chain of stitches for stitching onto material in a sewing machine having a needle and a throat plate, comprising:

means for cutting the chain of stitches;

means for positioning the severed chain forwardly of the needle;

an elongated nipper having an outwardly directed finger;

an elongated guide having a forwardly directed end portion defining a space between the finger and end portion;

an elongated plate having a forward end located adjacent the nipper finger on a side of the nipper opposite the guide;

means for moving the nipper, guide, and plate together from a location beneath the throat plate to a location with the finger and forward end of the plate being located adjacent the throat plate;

means for stopping motion of the plate with the forward end located adjacent the throat plate;

means for moving the nipper and guide together above the throat plate to catch the severed chain in the space;

means for moving the nipper and guide together to a location with the finger adjacent the throat plate to releasably grasp the captured chain between the finger and plate; and means for moving the nipper, guide, and plate together to a location beneath the throat plate to make the chain taut and releasably retain it in position for sewing onto a subsequent material to be sewn.

14. The apparatus of claim 13 wherein the end portion of the guide is curved.

15. The apparatus of claim 13 wherein the severed chain is located in a groove between the throat plate and a fabric cutter.

* * * * *

UNITED STATES PATENT AND TRADEMARK OFFICE

CERTIFICATE OF CORRECTION

PATENT NO. : 4,834,009

DATED : May 30, 1989

INVENTOR(S) : John Van Eyk

It is certified that error appears in the above-identified patent and that said Letters Patent is hereby corrected as shown below:

Title page, foreign application priority data, delete "June 2, 1986 [Au]Australia 58359/86"

Signed and Sealed this

Ninth Day of June, 1992

*Attest:*

DOUGLAS B. COMER

*Attesting Officer*

*Acting Commissioner of Patents and Trademarks*